US010190205B2

(12) United States Patent
Giovannini

(10) Patent No.: US 10,190,205 B2
(45) Date of Patent: Jan. 29, 2019

(54) METHOD AND APPARATUS FOR FLAME SPRAYING THERMOPLASTIC POWDERS

(71) Applicant: IBIX S.R.L., Santa Maria in Fabriago (IT)

(72) Inventor: Susanna Giovannini, Santa Maria in Fabriago (IT)

(73) Assignee: IBIX S.R.L., Santa Maria in Fabriago (IT)

( * ) Notice: Subject to any disclaimer, the term of this patent is extended or adjusted under 35 U.S.C. 154(b) by 49 days.

(21) Appl. No.: 15/036,166

(22) PCT Filed: Nov. 12, 2014

(86) PCT No.: PCT/IB2014/065991

§ 371 (c)(1),
(2) Date: May 12, 2016

(87) PCT Pub. No.: WO2015/071840

PCT Pub. Date: May 21, 2015

(65) Prior Publication Data

US 2016/0281203 A1 Sep. 29, 2016

(30) Foreign Application Priority Data

Nov. 12, 2013 (IT) ..... BO2013A0619

(51) Int. Cl.
*C23C 4/129* (2016.01)
*B05B 7/14* (2006.01)
(Continued)

(52) U.S. Cl.
CPC ..... *C23C 4/129* (2016.01); *B05B 7/1431* (2013.01); *B05B 7/1481* (2013.01);
(Continued)

(58) Field of Classification Search
CPC ..... C23C 4/129; B05B 7/1486; B05B 7/1431; B05B 12/10; B05B 12/004; B05B 7/205;
(Continued)

(56) References Cited

U.S. PATENT DOCUMENTS 5,262,206 A * 11/1993 Rangaswamy ..... B05B 7/203 427/447
5,932,293 A * 8/1999 Belashchenko ..... B05B 7/1606 118/308

(Continued)

FOREIGN PATENT DOCUMENTS

DE 44 43 811 A1 6/1996
FR 2 894 599 A1 6/2007

(Continued)

OTHER PUBLICATIONS

English Machine Translation of DE 4443811 (Kuenzli et al) published Jun. 13, 1996 (31 unnumbered pages).*

(Continued)

*Primary Examiner* — Laura Edwards
(74) *Attorney, Agent, or Firm* — McGlew and Tuttle, P.C.

(57) ABSTRACT

The method for spraying thermoplastic powders provides to feed a flow of compressed air and/or nitrogen and a liquefied petroleum gas through respective separated discharge chambers (9, 12), shaped inside a mixing device (1) of a spray gun (100), the separated discharge chambers (9, 12) being in communication with a mixing chamber (15). Then a flame is ignited at the mixing chamber, through a flame ignition device (30) connected with the gun (100), said device comprising a spark ignition device (31, 310), and a conductor element (32) associated with the mixing device (1) and connected with the spark ignition device (31, 310). The thermoplastic powders are mixed with a transport inert gas, and fed through a further discharge chamber (7) communicating with the mixing chamber (15). Then the spray gun is
(Continued)

operated to spray the thermoplastic powders through the flame onto the surface of the article to be coated, to cause the melting of the same powders.

18 Claims, 7 Drawing Sheets

(51) Int. Cl.

| | |
|---|---|
| ***B05B 7/16*** | (2006.01) |
| ***B05B 7/20*** | (2006.01) |
| ***B05B 12/00*** | (2018.01) |
| ***B05B 12/10*** | (2006.01) |
| ***B05D 1/10*** | (2006.01) |
| *B05D 3/02* | (2006.01) |
| *B05B 15/20* | (2018.01) |

(52) U.S. Cl.
CPC ..... *B05B 7/1486* (2013.01); *B05B 7/1626* (2013.01); *B05B 7/205* (2013.01); *B05B 12/004* (2013.01); *B05B 12/10* (2013.01); *B05D 1/10* (2013.01); *B05B 15/20* (2018.02); *B05D 3/0218* (2013.01)

(58) Field of Classification Search
CPC ... B05B 7/1626; B05B 7/1481; B05B 15/002; B05B 7/16; B05D 1/10; B05D 3/0218; B05D 1/08
USPC ..... 118/715
See application file for complete search history.

(56) References Cited

U.S. PATENT DOCUMENTS

2005/0255419 A1* 11/2005 Belashchenko ..... F23C 3/00 431/278
2011/0265715 A1 11/2011 Keller

FOREIGN PATENT DOCUMENTS

GB 553 099 A 5/1943
WO 00/29635 A2 5/2000

OTHER PUBLICATIONS

"Spritzsystem Fuer Strapazierfaehigere Beschichtungen", Schweissen und Schneiden, DVS Verlag, Dusseldorf, DE, vol. 48, No. 8, Aug. 1, 1996, p. 581, XP000621970, ISSN: 0036-7184.
International Search Report dated Feb. 11, 2015.

* cited by examiner

METHOD AND APPARATUS FOR FLAME SPRAYING THERMOPLASTIC POWDERS

TECHNICAL FIELD

The present invention concerns a method and an apparatus for flame spraying thermoplastic powders.

BACKGROUND ART

It has long been known the technique of coating by flame spraying thermoplastic powders applied by melting. Such technique is used for example for the production of anti-corrosive coatings on manufactured articles of different nature.

According to a known method, the thermoplastic powders are sprayed onto the manufactured article to be coated by means of a spray gun fed with compressed air and with a suitable liquefied petroleum gas. The gas flame produced by the spray gun transfers the melted particles of the powders onto the article to be coated.

The method of coating by flame spraying is of rapid and economic use and is suitable for coating different materials. The apparatuses currently used to obtain such coating, however, have certain drawbacks which limit their performance and thus make the use of the aforementioned method less effective.

In particular, it is often complained the fact that the spray gun is subject to overheating during its use. Such overheating causes an undesired adherence of the thermoplastic powders inside the gun, thus producing accumulations of powders about the outlet opening and inside the walls of the gun. This can as well adversely affect the physical characteristics of the powders to be sprayed.

Another problem complained in the field concerns the safety related to the use of the spray guns. In particular, with known spray guns, the ignition of the flame is performed by hand, by bringing an ignition device such as a lighter or a struck match at the exit of the gas from the spray gun. This obviously entails a high risk of accident.

Moreover, there exists the risk of accidental extinguishment of the flame during the use, which causes the supply of air and flammable gas in the environment. This entails a serious risk for users of the flame spray gun, as well as for the safety of those present in the surrounding environment.

DISCLOSURE

The task of the present invention is that of solving the aforementioned problem, devising a method which allows to perform in an optimal way the flame spraying of thermoplastic powders, ensuring in particular to maintain the physical characteristics of the powders to be sprayed.

Within such task, it is a further scope of the present invention to provide an apparatus for carrying out the above mentioned flame spraying method which does not cause overheating of the spray gun during its use.

A further scope of the invention is that of providing an apparatus for flame spraying thermoplastic powders which is able to ensure the safety of the user in any condition of use, in particular during the ignition of the flame, or in case of accidental extinguishment of the flame.

Another scope of the invention is that of providing an apparatus for flame spraying thermoplastic powders of simple constructive and functional conception, provided with surely reliable functioning, versatile use as well as relatively economic costs.

The cited scopes are achieved, according to the present invention, by the method and by the apparatus for flame spraying thermoplastic powders according to the attached claims.

In particular, the method according to the invention provides to ignite the flame through a suitable ignition device comprising a spark ignition device and a conductor element associated with the spray gun and connected with the ignition device, to create a spark inside or at the mixing device of the spray gun.

The method according to the invention provides, then, to feed a flow of compressed air and/or nitrogen and a flow of liquefied petroleum gas through respective separated discharge chambers, shaped inside a mixing device of a spray gun, the discharge chambers being in communication with a mixing chamber; to ignite the flame at the mixing chamber through the above mentioned flame ignition device, comprising an ignition device and a conductor element connected with the spray gun; optionally, to heat the article to be coated to a suitable working temperature; to mix the thermoplastic powders to be sprayed with a transport inert gas; to feed the thermoplastic powders, transported by the inert gas, through a further discharge chamber shaped inside the mixing device and communicating with the mixing chamber; to operate the spray gun to project the thermoplastic powders, transported by the inert gas, onto the surface of the article to be coated, so as to cause or to complete the melting of the thermoplastic powders in contact with the surface.

Preferably, the method according to the invention provides, after the ignition of the flame, to detect and monitor the presence of the same flame by means of a flame detection device.

Preferably, the method according to the invention provides as well to detect, through the flame detection device, an extinguishment of the flame and, consequently to the detection of the extinguishment of the flame, to operate the stop of the feeding of the liquefied petroleum gas. In this way, the supply of liquefied petroleum gas is stopped in short time and in automatic manner.

The present invention concerns as well an apparatus for flame spraying thermoplastic powders comprising a spray gun and an ignition device for the flame, provided with an ignition device of a spark, and a connector element associated with the spray gun and connected with the ignition device, so as to ignite the spark inside or at the mixing chamber of the spray gun.

According to the invention, the spray gun is configured to perform the spraying of thermoplastic powders and is configured to be fed with a liquefied petroleum gas for the production of a flame to be directed to the article to be coated to heat the surface of the same article to a suitable working temperature. The above mentioned spray gun comprises a mixing device provided in its inside with separated discharge chambers, configured to be fed with the thermoplastic powders to be sprayed mixed with a transport inert gas, with a flow of compressed air and/or nitrogen and with the liquefied petroleum gas, as well as a mixing chamber communicating with the above mentioned discharge chambers.

According to an embodiment, the apparatus according to the invention further comprises a detection device of the flame, configured to detect and monitor the presence of the flame.

Preferably, the detection device is connected, directly or indirectly, with a valve configured to allow or interrupt the feeding of the liquefied petroleum gas.

DESCRIPTION OF DRAWINGS

Details of the invention shall be more apparent from the detailed description of a preferred embodiment of the apparatus for flame spraying thermoplastic powders according to the invention, illustrated for indicative purposes in the attached drawings, wherein.

BEST MODE

Figure 1:
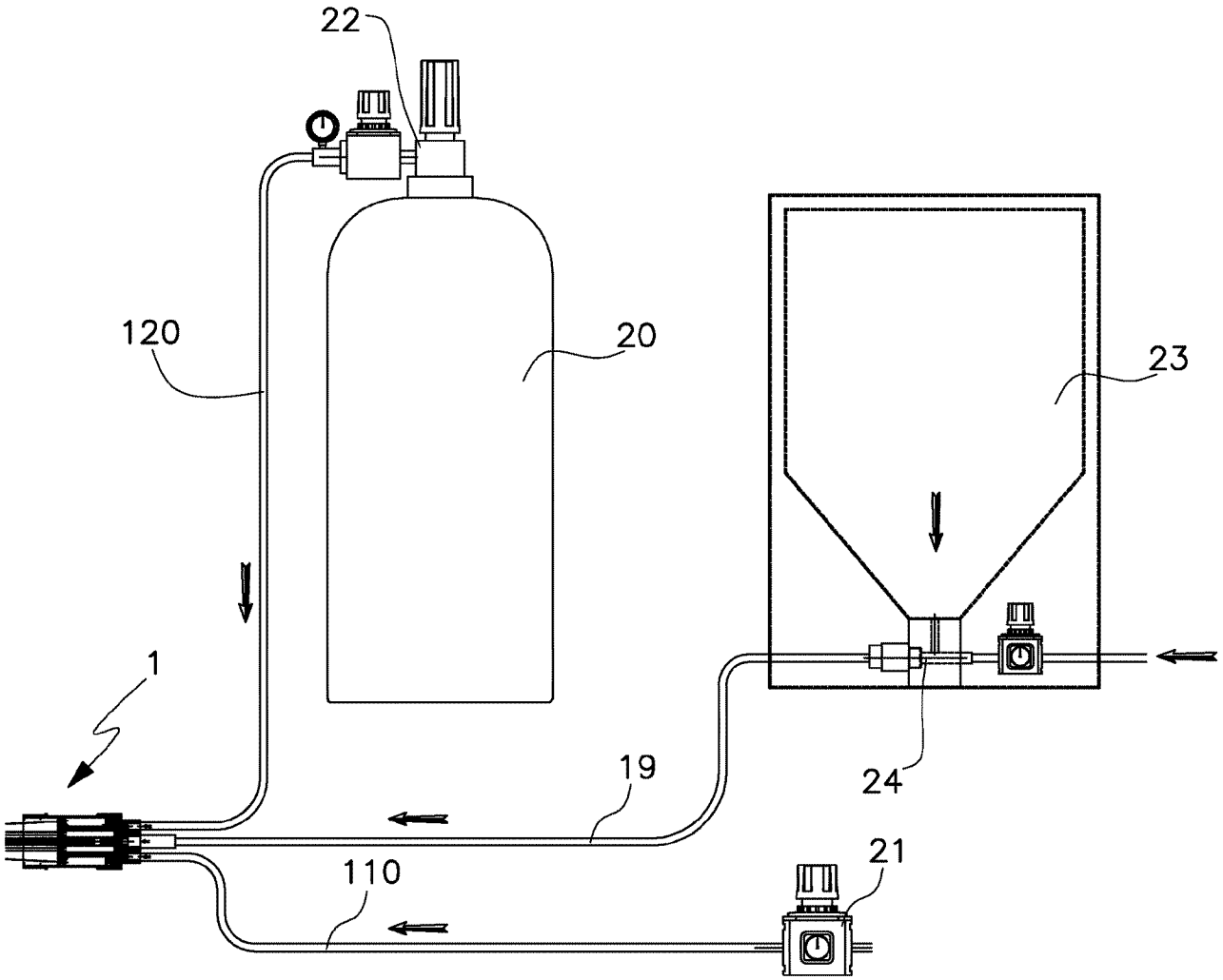
FIG. 1 shows a schematic overall view of the apparatus for flame spraying thermoplastic powders according to the invention.
Figure 2:
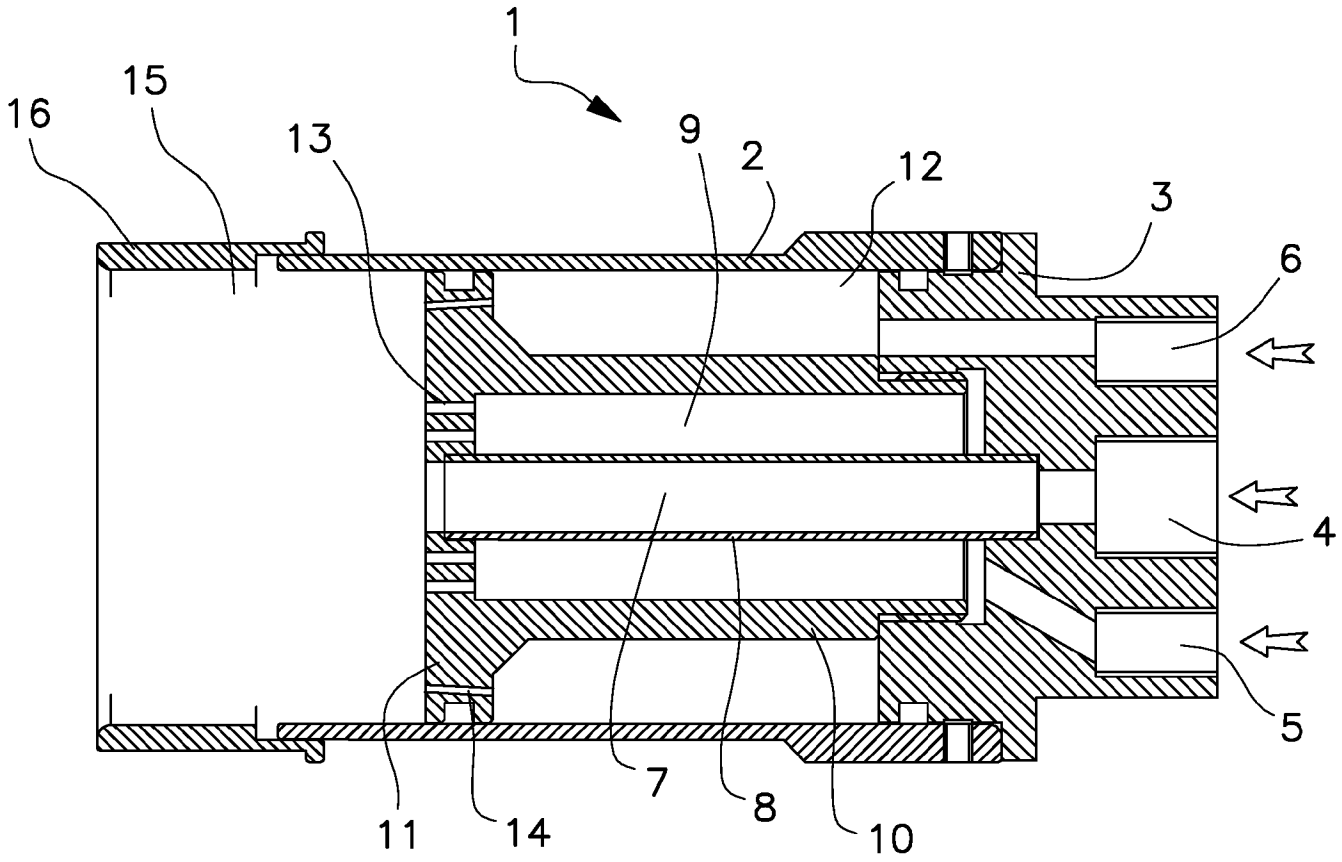
FIG. 2 shows a longitudinal cross-section view of a mixing device associated with the spray gun of the apparatus according to the invention.

With particular reference to such figures, the spray gun of the apparatus for flame spraying thermoplastic powders according to the invention has been indicated in its entirety with 100.

A mixing device 1 is associated with the spray gun 100, the mixing device 1 being made up of a body 2 of tubular shape carrying, at a rear edge, a sealed head element 3, in which there are a first duct 4 for the feeding of the thermoplastic powders, transported by an inert gas, a second duct 5 for the feeding of a flow of compressed air and a third duct 6 for the feeding of liquefied petroleum gas or GPL, of the type for example of propane. As an alternative, it is possible to feed through the second duct 5 a mixture of air and nitrogen or possibly only nitrogen. Obviously, it is possible to provide the use of a different gas according to the exigencies, also in mixtures, for example a mixture of propane and butane.

The air is fed to the spray gun through an air compressor, of known type, not represented in figures, through a relative piping 110; the propane is fed to the spray gun through a suitable air cylinder 20, through a relative piping 120. Obviously, the piping 110, 120 of the air compressor and of the cylinder of the propane are provided with suitable members 21, 22 for the adjustment of the outflow.

Figure 3:
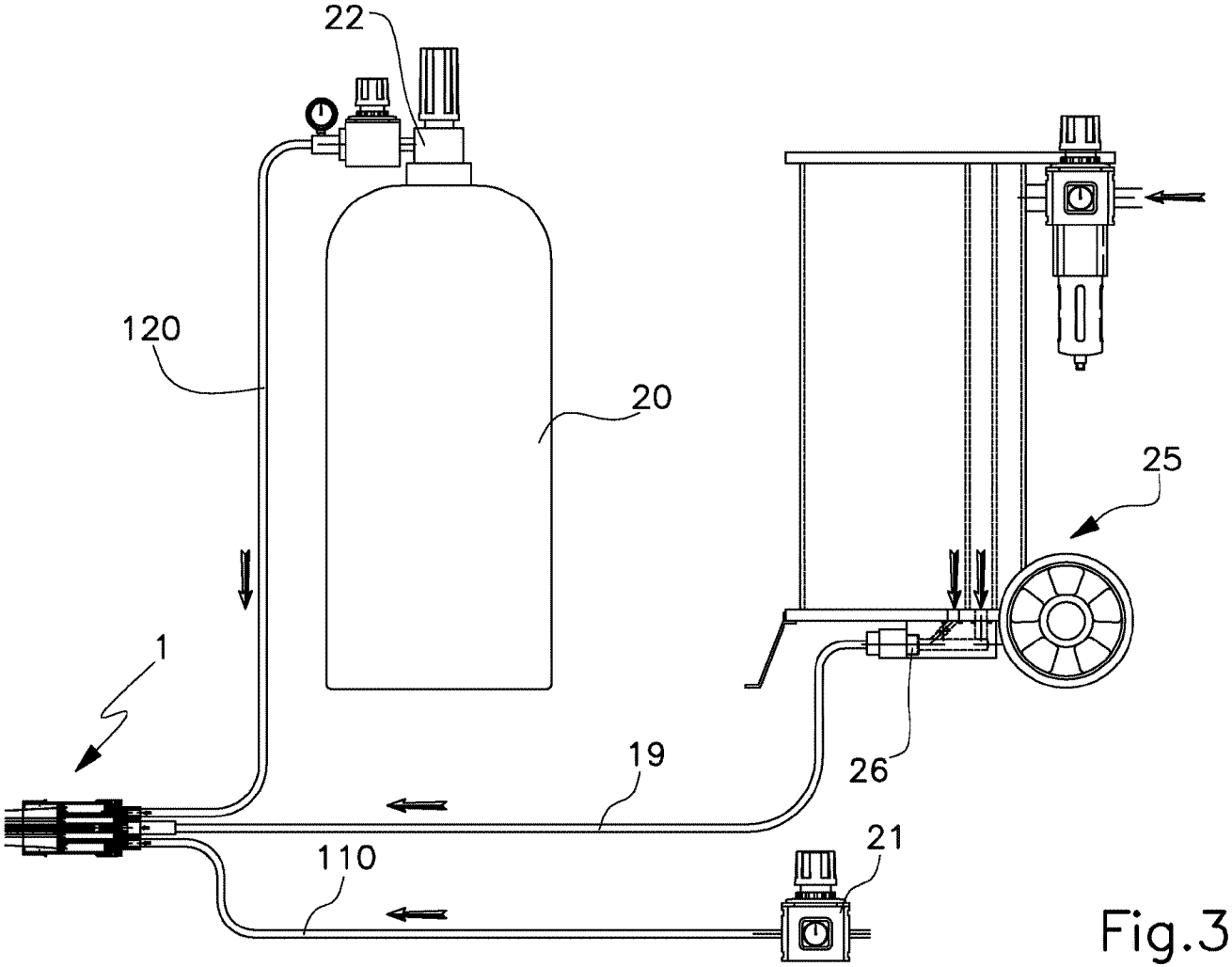
FIG. 3 shows a schematic overall view of a different embodiment of the apparatus for flame spraying thermoplastic powders according to the present invention.

The first duct 4 for the feeding of the powders is connected with a first discharge chamber 7 shaped by an internal tubular element 8 arranged according to the longitudinal axis of the body 2. The thermoplastic powders are fed to the duct 4 by a suitable load container 23, through a relative piping 19, with the interposition of a member 24, so called Venturi meter, configured to cause the controlled release of the same powders. As an alternative, it is possible to provide, instead of the Venturi meter, a feed device 25 provided with a suitable mixing valve 26, as it is shown in FIG. 3.

The second duct 5 for the feeding of the mixture of air and/or nitrogen is connected with a second discharge chamber 9 shaped by a sleeve 10 externally coaxial to the internal tubular element 8. The second discharge chamber 9 is therefore shaped in annular shape between the inner surface of the sleeve 10 and the above mentioned internal tubular element 8.

The sleeve 10 is tightly coupled, at a rear edge, with the head element 3 of the device, while at the front edge it shapes a front flange 11 which is associated, with sealing, with the inner surface of the body 2. Between such inner surface of the body 2 and the sleeve 10, a third discharge chamber 12 is shaped, which is in communication with the third duct 6 for the feeding of the propane gas.

The internal tubular element 8 is constrained at its opposite ends respectively to the head element 3 and to the front flange 11, the front flange being provided with a suitable axial opening.

The front flange 11 has, passing through, a first series of nozzles 13 and a second series of nozzles 14 configured to put in contact respectively the second discharge chamber 9 and the third discharge chamber 12 with a mixing chamber 15 shaped frontally to the same front flange 11. Such mixing chamber 15 extends inside an annular sleeve 16 frontally inserted on the body 2.

Figure 4:
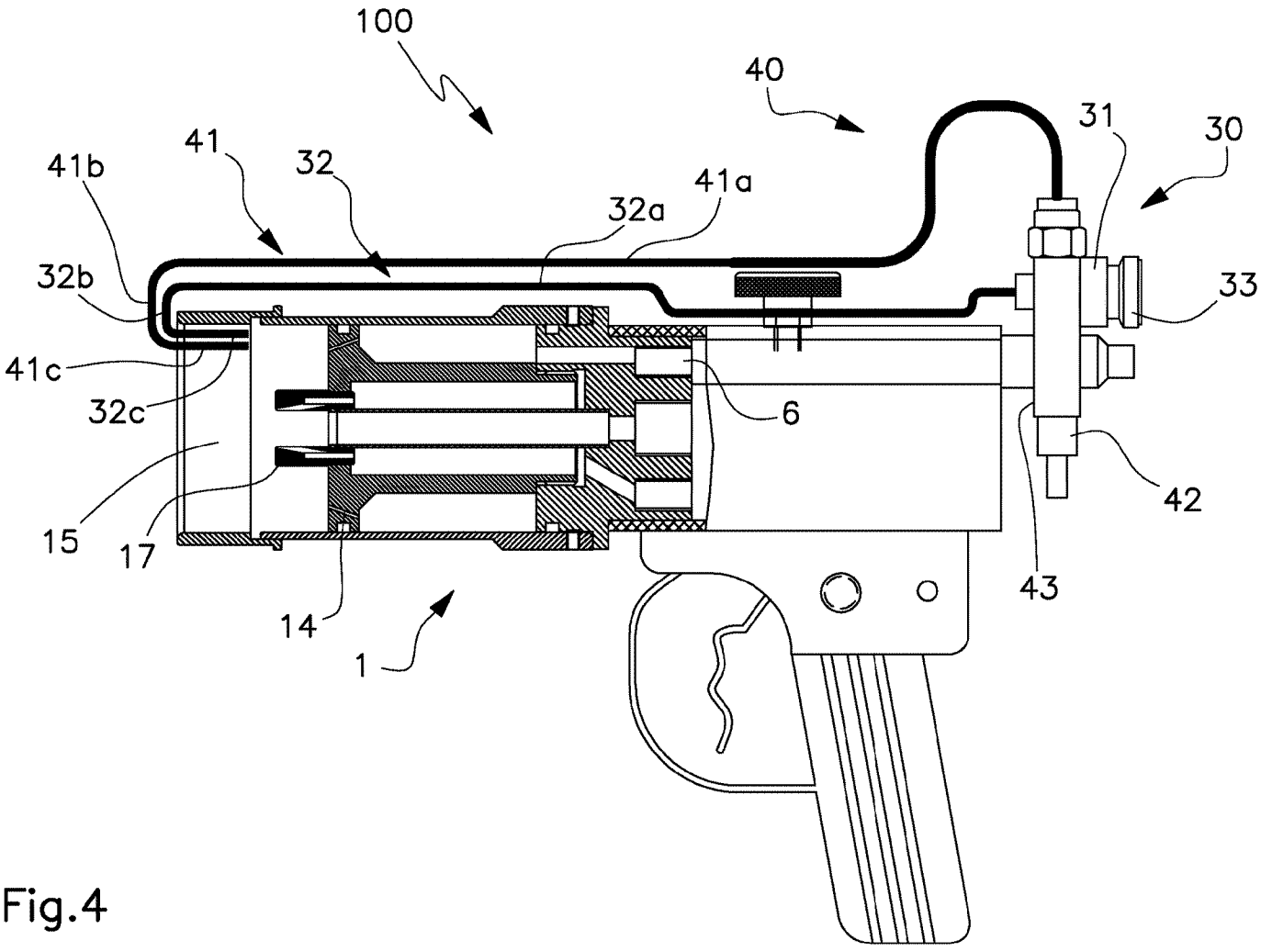
FIG. 4 shows a longitudinal cross-section view of the spray gun according to a preferred embodiment of the apparatus according to the invention.

It is possible to provide that the first series of nozzles 13 is of the type provided with a deflector member 17, as it is shown for example in FIG. 4, such as to allow the adjustment of the width of the coating jet of the thermoplastic powder to be sprayed.

The apparatus for spraying thermoplastic powders comprises a suitable flame ignition device 30. More precisely, such flame ignition device 30 is fixed to the gun 100 and comprises a spark strike device 31, 310, and a conductor element 32 associated with the mixing device 1. The conductor element 32 is connected with the spark strike device 31, 310 to ignite a spark inside or at the mixing chamber 15.

Preferably, the spark ignition device 31 is of the piezoelectric type, and is mounted on the spray gun. The conductor element 32, made up for example of an electrode (see FIG. 4) being rod-shaped, is connected at one end with the piezoelectric spark ignition device 31, and is provided with another free end at which a spark can be produced. The piezoelectric spark ignition device 31 is configured to produce a high-tension spark at the free end of the electrode 32, so as to start the flame.

To such end, it is suitable that the electrode 32 is arranged in a way such as the spark is produced in the above mentioned mixing chamber 15, or close to it, to cause the ignition of the flame. Preferably, as it is shown in FIG. 4, the free end of the electrode 32 is placed inside the mixing chamber 15. Advantageously, the free end of the electrode 32 is located close to the above mentioned second series of nozzles 14, from which the liquefied petroleum gas comes out.

It is to be noted that, in the disclosed arrangement, during the supply of the flame, the free end of the electrode 32 is crossed by the same flame.

It is as well to be noted that the piezoelectric spark ignition device 31 is suitably provided with an activation means 33, for example a key, to enable the user to operate the piezoelectric spark ignition device 31 directly on the gun. More precisely, the operation key 33 is arranged so as to be easy reached by the user which uses the spray gun.

Preferably, the conductor element 32 comprises at least one first portion 32*a* extended longitudinally to the mixing device 1, and the spark ignition device 31 is arranged at a rear portion of the gun.

Figure 5:
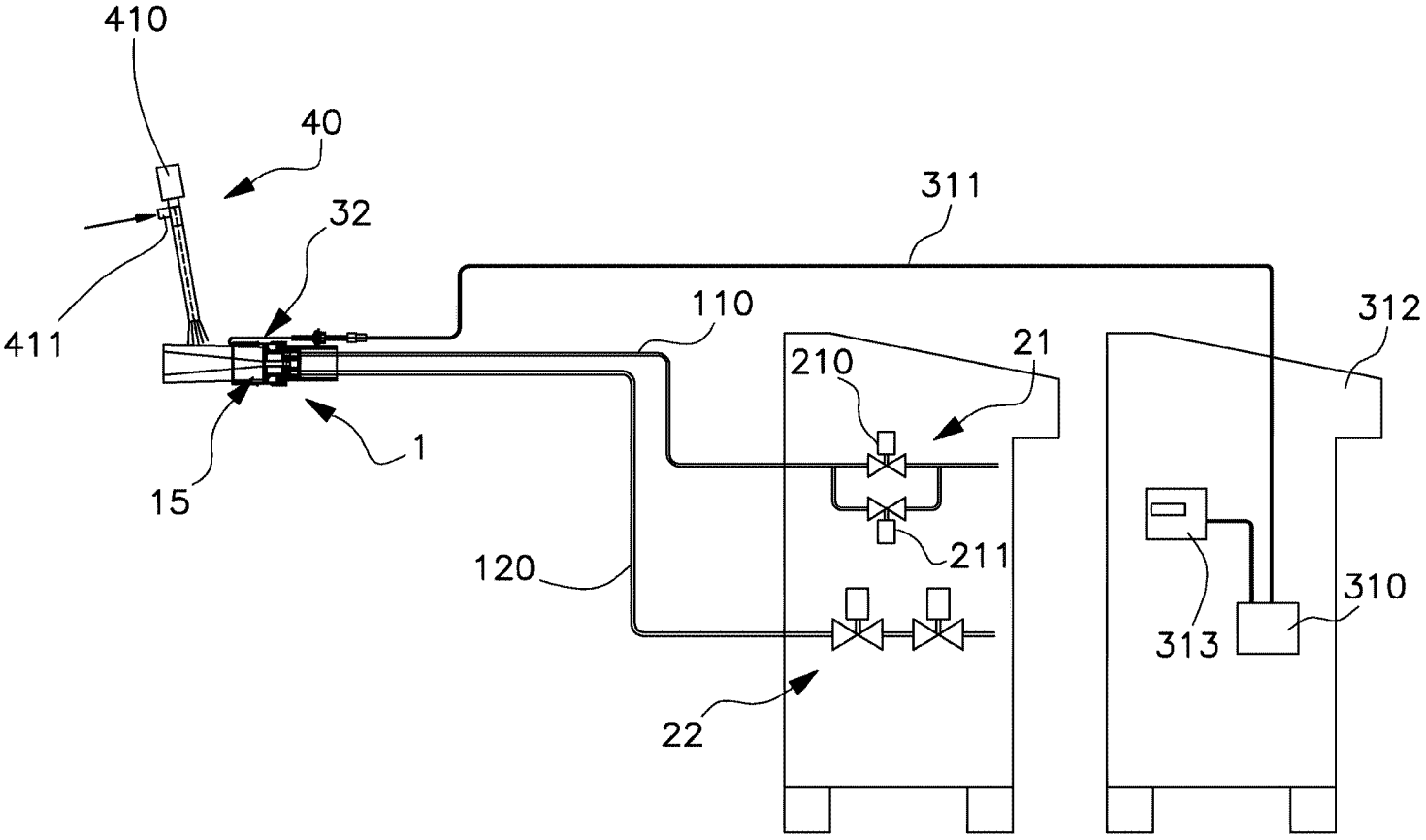
FIG. 5 shows a schematic overall view of a further embodiment of the apparatus for flame spraying thermoplastic powders.

In an alternative embodiment, the ignition device 30 has an electric spark ignition device 310, such as a transformer, connected with the electrode 32 through a suitable electric cable 311 (FIG. 5). In this embodiment, the spark ignition transformer 310 is arranged spaced from the spray gun, more precisely in a command board 312. The operation key for the above mentioned transformer 310 is arranged on the command board 312, so as to allow the remote starting of the flame.

In this embodiment, an electronic command device 313 is also provided, suitably arranged in the command board 312 and electrically connected with the transformer 310, as well as with the valve members 21, 22 for the adjustment of the discharge of air and gas, so as to control the activation thereof.

The electronic command device 313 is configured to receive an activation signal from the ignition device 30 which confirms the correct ignition of the flame.

According to a preferred embodiment, the body of the electrode 32 has a first portion 32*a*, connected with the spark ignition device 31, 311 and longitudinally extended along the mixing device 1 on its whole length, a second portion 32*b* transversal to the first portion 32*a* and oriented towards the inside of the mixing chamber 15, and a third end portion 32*c*, substantially parallel to the first portion 32*a* and oriented in opposite direction, so as to result oriented towards the second series of nozzles 14, as previously mentioned.

Alternatively, it is possible to provide that the electrode 32 is made up only of a first portion, longitudinal to the mixing device 1, and of a second end transversal portion, which crosses the tubular body 2 of the mixing device 1, so that its edge results to be at the second series of nozzles 14.

The apparatus for spraying thermoplastic powders is preferably provided with a detection and monitor device 40 for the flame, configured to detect and monitor, preferably in continuous way, the presence of the flame coming out of the spray gun. The detection and monitor device 40 is as well suitable, in case of accidental extinguishment of the flame, to automatically operate the stop of the outflow of liquefied petroleum gas.

According to a preferred embodiment, such detection device 40 has temperature detection means 41, for example a thermocouple associated with the spray gun, and actuation means 42, for example a valve connected with the thermocouple 41, the valve 42 being configured to enable or interrupt the feeding of the liquefied petroleum gas. As it is possible to see in FIG. 4, the thermocouple 41 and the valve 42 are suitably connected at an external tubular element 43 associated with the spray gun and associated with the duct 6 for the feeding of the LPG, for the benefit of the compactness and manageability of the gun. According to the embodiment shown in FIG. 4, the external tubular element 43 is mounted at the rear portion of the gun 1, so as to cross the duct 6, engaging it through the valve 42. According to such configuration, the valve 42 can be therefore operated between a closure position, in which it prevents the passage of LPG in the duct 6, and an open position, in which it allows the passage of LPG in the duct 6.

In FIG. 4 it is also possible to see that the piezoelectric flame ignition device 31 is preferably mounted in fixed manner on the above mentioned external tubular element 43, thus giving the gun a reduced volume.

As disclosed for the electrode 32 of the ignition device 30, in the example of FIG. 4, the thermocouple 41 has a rod-shaped body comprising a first portion 41*a*, external and longitudinal to the mixing device 1, a second transversal portion 41*b* arranged at the exit of the mixing chamber 15, and a third end portion 41*c*, arranged longitudinally to the mixing device 1 and oriented towards the inside of the mixing chamber 15. Alternatively, it is possible to provide a thermocouple comprising a first portion external and longitudinal to the mixing device 1, and a second transversal end portion which passes through the wall of the tubular body 2 so as to have its end outside of the second series of nozzles 14 for the supply of gas.

According to a second embodiment, shown in FIG. 5, the detection and monitor device 40 of the flame is provided with optical detection means 410, for example a photocell, arranged in such a manner as to be able to visually detect the presence of the flame. In the example shown in FIG. 5, the photocell 410 is oriented towards the exit of the mixing chamber 15 of the mixing device 1.

It is to be noted that in the example of FIG. 5, the photocell 410 is provided with a cooling device 411, configured in this case to allow the inlet and the circulation of air in proximity of the photocell 410 in order to cool it.

In the embodiment illustrated in FIG. 5, the detection device 40 is electrically connected with the electronic command device 313, and is configured to send it a suitable signal in case the flame is no more detected.

It is to be specified that the embodiments illustrated respectively in FIGS. 4 and 5 do not represent a restriction of the combination of the embodiments of the ignition device 30 and of the detection and monitor device 40 for the flame. In particular, it is possible to provide a gun provided with the piezoelectric spark ignition device 31 and with the photocell 410. It is possible as well to provide that the gun is connected with the electric spark ignition device 310 and equipped with the thermocouple 41.

Alternatively, it is possible to provide that the spray gun is provided with a monoelectrode, which is configured to perform the ignition of the spark, in particular inside the mixing chamber 15, as well as to perform the detection and the monitoring of the flame, inside the mixing chamber 15. In such case, it is necessary that the free end of the monoelectrode is crossed by the flame to be monitored.

According to the embodiment shown in FIG. 5, the valve member 21 of control of the supply of air comprises a first valve 210, configured to allow the supply of low-pressure air, and a second valve 211, adapted to allow the supply of high-pressure air.

Figure 6:
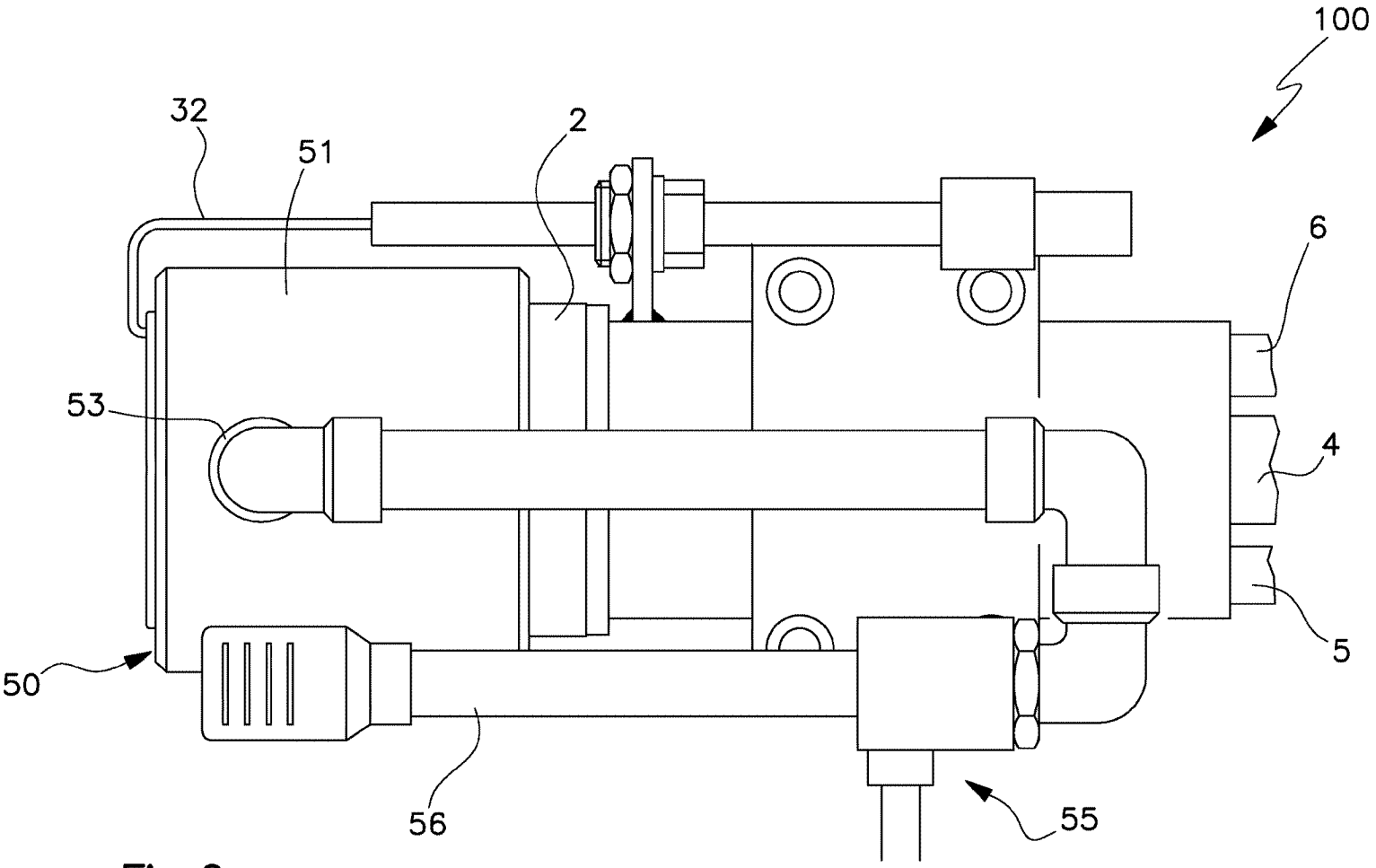
FIG. 6 shows a side view of a further embodiment of the spray gun of the apparatus according to the invention.
Figure 7:
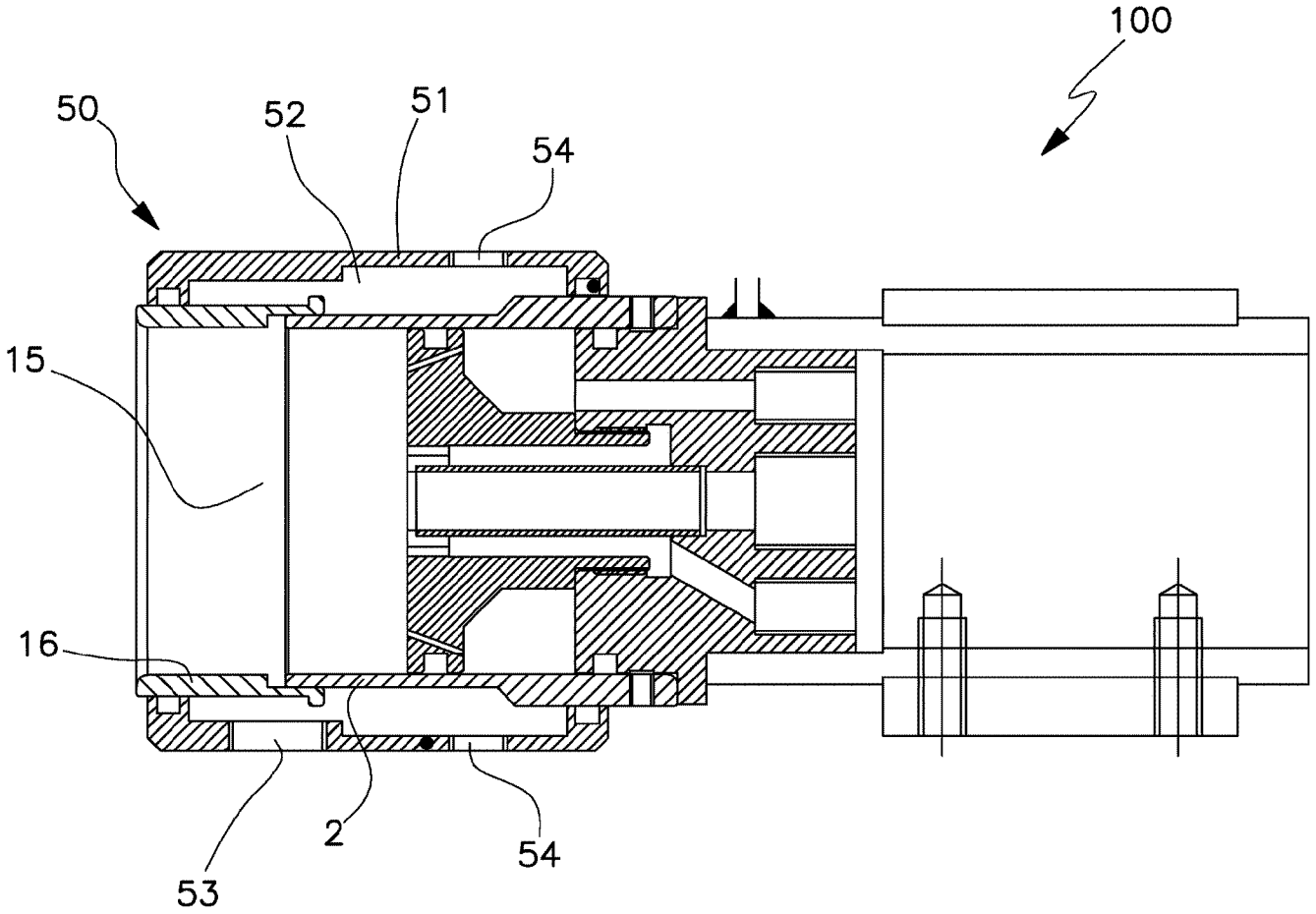
FIG. 7 shows a partial longitudinal cross-section view of the embodiment of FIG. 6.

According to a further embodiment, shown in FIGS. 6 and 7, the apparatus according to the invention comprises as well a cooling device 50 for the gun 100, associated with the mixing device 1 of the same gun 100.

In particular, the cooling device 50 comprises a hollow tubular body 51 adapted to be arranged, in use, about the mixing device 1, more precisely, around and coaxial to the body 2 of tubular shape and around the annular sleeve 16 inserted frontally to said body. The hollow tubular body 51 is adapted to shape, about the mixing chamber 15 of the gun 100, a cooling chamber 52 in which a cooling fluid is to be fed (FIG. 7).

The hollow tubular body 51 is suitably provided with at least one inlet opening 53 for the inlet of the above mentioned cooling fluid and of at least one outlet opening 54 for the outlet of the same cooling fluid.

Preferably, the inlet opening 53 and the outlet opening 54 are arranged on the longitudinal wall of the hollow tubular body 51.

The cooling device 50 comprises feed means 55 for the cooling fluid, suitably connected with the inlet opening 53, and a cooling member 56, connected with feed means 55 of the fluid. The cooling member 56 is preferably tightly connected with the device 50 through the feed means 55, and is arranged close to the tubular body 51, to increase the efficiency and the manageability of the cooling device.

In the example shown in FIG. 6, such cooling member 56 is of the pneumatic type, but it is possible to provide other kinds of cooling members.

According to an advantageous embodiment, the cooling fluid is air, which is cooled by the cooling member 56. Obviously, it is possible to provide any other type of cooling fluid according to the exigencies.

The functioning of the apparatus for flame spraying thermoplastic powders according to the invention is easy to understand from the preceding description.

Firstly, the flame of the spray gun is ignited through the activation key 33 of the ignition device 31. It is obviously necessary that the valve member 22 for the supply of the liquefied petroleum gas is already open.

When the flame is burning, its presence is detected by the thermocouple 41. The width of the flame is then adjusted by controlling the flow of compressed air fed through the second discharge chamber 9.

It is possible to heat the article to be coated, according to its material, to a suitable working temperature, for example comprised between 90° and 200° C. The working temperature is essentially determined by the melting temperature of the used powders and can be then different form the one indicated for exemplary purpose.

Such heating is suitably performed through the flame produced by the same spray gun of the apparatus, upon effect of the mixing of the propane gas and of the compressed air, or other inert gas such as for example nitrogen, fed to the front chamber 15 of the gun.

The compressed air coming from the air compressor and the liquefied petroleum gas coming from the relative cylinder 20 are directed to the spray gun through the suitable valve members 21, 22 of control of the mixing which allow as well to adjust the exit pressure of the mixture.

The thermoplastic powders to be sprayed on the article are fed to the spray gun mixed with the cited transport inert gas, along with the air and the propane gas. The release of the powders is controlled by the cited Venturi meter member 24 or alternatively by the cited mixing valve 26.

Inside the spray gun, the thermoplastic powders coming out of the discharge chamber 7 shaped by the sleeve 8 mix with the flow of air and/or nitrogen coming out of the coaxial discharge chamber 9. At this point, the thermoplastic powders pass through the above mentioned flame produced by the gun, and are heated inside the same flame.

It is to be noted that the apparatus according to the invention allows to control the melting of the thermoplastic powders inside the flame, enabling the user to adjust the width of the flame according to his needs through a suitable adjustment of the feed of air and LPG.

Therefore, it is possible to adjust the flows of air and LPG to obtain a short flame and a high flow of powders. In such configuration, the passage time of the powders inside the flame is very short, this allowing to preserve the properties of the powder without providing a protection measure of the powder, such as for example the simultaneous feeding of a flow of nitrogen.

As an alternative, it is possible to adjust the flows of air and LPG to obtain a long flame, so as to start the melting of the powders inside the flame. In such case, it is possible to spray the powders on a surface without pre-heating. Such a solution is particularly advantageous for coating surfaces of concrete type.

The powders are then expelled from the spray gun and, inside the flame, projected onto the surface of the article to be coated. The desired melting of the powders is produced, or completed, at the contact of the surface of the article.

An accidental extinguishment of the flame is automatically detected by the thermocouple 41. Such detection causes the closure of the valve 42, thus interrupting the feeding of the liquefied petroleum gas.

The method and the apparatus according to the invention achieve the scope of performing in an optimal way the spraying of thermoplastic powders, ensuring the preservation of the physical characteristics of the powders to be sprayed, as well as the safety of the users.

Such a result is achieved by virtue of the inventive idea of providing a flame ignition device equipped with a spark ignition device 31, 310 and with a conductor element 32 associated with the mixing device 1. Such device allows to avoid to start the flame through a lighter or a struck match being moved by hand towards to the outlet of the spray gun.

It is to be underlined that the specific shape of the electrode 32 and of the thermocouple 41 reduce the space required by the spray gun, with the advantage of an improved manageability of the same.

A feature of the apparatus according to the present invention is also to provide a detection and monitoring device for the presence of the flame, advantageously adapted to allow the stop of the feeding of the liquefied petroleum gas.

A characteristic of the present invention is as well to provide that, is case of extinguishment of the flame, the detection device sends a turn-off signal to the electronic control device, which subsequently operates the interruption of the feed of the liquefied petroleum gas. In such way, it is possible to prevent in a totally automatic way any possible dispersion of gas in the working environment, in favour of an even greater safety.

This is specifically obtained by virtue of the particular shape of the mixing device of the spray gun. The discharge chamber 9, which is reached by the mixture of air and/or nitrogen, shaped by the sleeve 10, is able to perform a cooling and protection action with respect to the internal tubular element 8 through which the powders are fed.

A feature of the apparatus according to the invention is to be compact and easy to transport in the working area. Usefully, the apparatus according to the invention can be mounted on a suitable wheel structure so as to be portable.

Ad advantage of the apparatus according to the invention is due to the fact of allowing the spraying of the coating, creating different layers, by means of a single spray or by more subsequent sprays.

A further advantage of the apparatus according to the invention is to work with a high spraying speed, so as to achieve a high productiveness.

It is finally to be observed that the apparatus according to the invention is of simple and steady construction and has a relatively reduced cost.

According to the embodiment shown in FIG. 5, the ignition of the flame occurs through the operation key placed in the command board 312.

The operation of such key simultaneously determines the opening of the valve member 22 for the supply of the liquefied petroleum gas, the opening of the valve member 21 for the supply of the air as well as the ignition of the spark at the end of the electrode 32, so as to start the flame.

More precisely, in case the valve member 21 for the supply of the air is equipped with the above mentioned first and second valve 210, 211, the operation of the activation key determines the simultaneous opening of the valve member 22 for the supply of the gas, the opening of the fist valve 210 for the supply of low pressure air, as well as the ignition of the spark to start the flame.

Once the flame is started, the photocell 410 sends a suitable signal to the electronic command device 313. Also in case the valve member 21 for the supply of air is provided with the above mentioned first and second valve 210, 211, the electronic command device 313 will open the second valve 211 for the supply of the high-pressure air, to obtain a flame of greater volume.

In case the flame of the mixing device 1 accidentally turns off, the photocell 410 automatically sends a suitable signal to the electronic command device 313, which in short time closes the valve member 22 for the supply of the liquefied petroleum gas. Obviously, it is possible to provide that the electronic command device 313, through the signal received by the photocell 410, closes as well the valve member 21 for the supply of the air.

According to the embodiment shown in FIGS. 6 and 7, the overheating of the gun 100 is further prevented through the cooling device 50. Once the flame is ignited, the feeding means for the air 55 are operated along with the cooling member 56 which provides the cooling of the fed air. The so obtained cooled air is fed inside the cooling chamber 52 through the inlet opening 53.

Inside the cooling chamber 52, the cooled air is put in contact with the body 2 and the sleeve 16, inside which the flame is produced. Such contact allows a thermal exchange between the air and the body 2 and the sleeve 16, performing in known way the cooling of these latter. The air, which in the meantime has been heated, comes out from the cooling chamber 52 through the outlet opening 54.

In practice, the embodiment of the invention, the materials used, as well as the shape and dimensions, may vary depending on the requirements.

Should the technical characteristics mentioned in each claim be followed by reference signs, such reference signs were included strictly with the aim of enhancing the understanding the claims and hence they shall not be deemed restrictive in any manner whatsoever on the scope of each element identified for exemplifying purposes by such reference signs.

The invention claimed is:

1. An apparatus for flame spraying thermoplastic powders, the apparatus comprising:

a spray gun configured to perform spraying of thermoplastic powders and to be fed with a liquefied petroleum gas for producing a flame to be directed on an article to be coated in order to heat a surface of said article to a predetermined working temperature, said spray gun comprising a mixing device internally defining separated discharge chambers, said separated discharge chambers being configured to be fed with said thermoplastic powders to be sprayed with a transport inert gas, with a flow of compressed air and/or nitrogen and with said liquefied petroleum gas, and said spray gun comprising a mixing chamber communicating with said separated discharge chambers;

a flame ignition device for igniting said flame, connected to said spray gun and said flame ignition device comprising a spark ignition device, and a conductor element associated with said mixing device and said conductor element being connected to said spark ignition device so as to produce a spark at said mixing chamber;

a flame detection and monitor device configured to detect and monitor a presence of said flame;

an actuator means for interrupting or enabling a feed of the liquefied petroleum gas, said flame detection and monitor device being connected, directly or indirectly, with said actuator means, said spark ignition device comprising a piezoelectric spark ignition device fixed to said mixing device, said piezoelectric spark ignition device being provided with an activation means, said flame detection and monitor device comprises a temperature detection means associated with said mixing device;

a duct for feeding said liquefied petroleum gas in communication with one of said separated discharge chambers configured to be fed with said liquefied petroleum gas, said actuator means comprising a valve associated with said duct and said valve being housed in an external tubular element mounted on an end of said spray gun so as to intersect said duct, said valve being connected with said temperature detection means and said spark ignition device being mounted in a fixed manner on said external tubular element.

2. An apparatus according to claim 1, wherein said conductor element comprises at least one first portion extending longitudinally to the mixing device and said spark ignition device is arranged at a rear portion of the spray gun.

3. An apparatus according to claim 1, further comprising a cooling device associated with said mixing device for cooling said spray gun, said cooling device comprising a hollow tubular body provided with at least one inlet opening and at least one outlet opening and arranged in a way as to define, about said mixing chamber, a cooling chamber wherein a cooling fluid is to be fed, said cooling device further comprising a feed means for said cooling fluid, rigidly connected with said at least one inlet opening, and said cooling device further comprising at least one cooling member of the fluid, rigidly connected with said feed means of the fluid.

4. An apparatus according to claim 3, wherein said at least one inlet opening and said at least one outlet opening are arranged on a longitudinal wall of said hollow tubular body.

5. An apparatus according to claim 4, wherein said cooling member is a pneumatic type cooling member.

6. An apparatus according to claim 3, wherein said cooling member is a pneumatic type cooling member.

7. An apparatus for flame spraying thermoplastic powders, the apparatus comprising:

a spray gun comprising a spray gun housing having an outer spray gun housing surface, said spray gun being configured to perform spraying of thermoplastic powders and to be fed with a liquefied petroleum gas for producing a flame to be directed on an article to be coated in order to heat a surface of said article to a predetermined working temperature, said spray gun comprising a mixing device internally defining separated discharge chambers, said separated discharge chambers being configured to be fed with said thermoplastic powders to be sprayed with a transport inert gas, with a flow of compressed air and/or nitrogen and with said liquefied petroleum gas, and said spray gun comprising a mixing chamber communicating with said separated discharge chambers, said mixing chamber being located in an interior of said spray gun housing;

a flame ignition device for igniting said flame, connected to said spray gun and said flame ignition device comprising a spark ignition device, and a conductor element associated with said mixing device and said conductor element being connected to said spark ignition device so as to produce a spark at said mixing chamber, said conductor extending from said spark ignition device to said mixing chamber, said conductor comprising a conductor end portion and another conductor portion, said conductor end portion being located in said mixing chamber, said another conductor portion extending along said outer spray gun housing surface at a position located outside of said spray gun housing, at least a portion of said flame ignition device engaging said spray gun housing outer surface;

a flame detection and monitor device configured to detect and monitor a presence of said flame;

an actuator means for interrupting or enabling a feed of the liquefied petroleum gas, said flame detection and monitor device being connected, directly or indirectly, with said actuator means, said flame detection and monitor device comprising a temperature detection means associated with said mixing device;

a duct for feeding said liquefied petroleum gas in communication with one of said separated discharge chambers configured to be fed with said liquefied petroleum gas, said actuator means comprising a valve associated with said duct and said valve being housed in an external tubular element mounted on an end of said spray gun housing so as to intersect said duct, said valve being connected with said temperature detection means and said spark ignition device being mounted in a fixed manner on said tubular element.

8. An apparatus according to claim 7, wherein said spark ignition device comprises a piezoelectric spark ignition device fixed to said mixing device, said piezoelectric spark ignition device being provided with an activation means for activating said piezoelectric spark ignition device such that said piezoelectric spark ignition device generates an electrical charge.

9. An apparatus according to claim 8, wherein said electrical charge is delivered to said mixing chamber via said conductor.

10. An apparatus according to claim 7, wherein said conductor element comprises at least one first portion extending longitudinally to the mixing device and said spark ignition device is arranged at a rear portion of the spray gun.

11. An apparatus according to claim 8, wherein said spark ignition device is mounted in a fixed manner on said external tubular element.

12. An apparatus according to claim 11, further comprising a cooling device associated with said mixing device for cooling said spray gun, said cooling device comprising a hollow tubular body provided with at least one inlet opening and at least one outlet opening and arranged in a way as to define, about said mixing chamber, a cooling chamber wherein a cooling fluid is to be fed, said cooling device further comprising a feed means for said cooling fluid, rigidly connected with said at least one inlet opening, and said cooling device further comprising at least one cooling member of the fluid, rigidly connected with said feed means of the fluid.

13. An apparatus according to claim 12, wherein said at least one inlet opening and said at least one outlet opening are arranged on a longitudinal wall of said hollow tubular body.

14. An apparatus according to claim 13, wherein said cooling member is a pneumatic type cooling member.

15. An apparatus for flame spraying thermoplastic powders, the apparatus comprising:

a spray gun comprising a spray gun housing having a spray gun housing outer surface, said spray gun being configured to perform spraying of thermoplastic powders and to be fed with a liquefied petroleum gas for producing a flame to be directed on an article to be coated in order to heat a surface of said article to a predetermined working temperature, said spray gun comprising a mixing device internally defining separated discharge chambers, said separated discharge chambers being configured to be fed with said thermoplastic powders to be sprayed with a transport inert gas, with a flow of compressed air and/or nitrogen and with said liquefied petroleum gas, and said spray gun comprising a mixing chamber communicating with said separated discharge chambers, said mixing chamber being located in an interior of said spray gun housing;

a flame ignition device for igniting said flame, connected to said spray gun and said flame ignition device comprising a spark ignition device, and a conductor element associated with said mixing device and said conductor element being connected to said spark ignition device so as to produce a spark at said mixing chamber, said conductor extending from a position located external to said spray gun housing outer surface to a position in said mixing chamber, wherein at least a portion of said conductor is arranged in said mixing chamber and another portion of said conductor is directly connected to said spark ignition device at a position located outside of said spray gun housing, at least a portion of said flame ignition device engaging said spray gun housing outer surface;

a flame detection and monitor device configured to detect and monitor a presence of said flame;

an actuator means for interrupting or enabling a feed of the liquefied petroleum gas, said flame detection and monitor device being connected, directly or indirectly, with said actuator means, said flame detection and monitor device comprising a temperature detection means associated with said mixing device;

a duct for feeding said liquefied petroleum gas in communication with one of said separated discharge chambers configured to be fed with said liquefied petroleum gas, said actuator means comprising a valve associated with said duct and said valve being housed in an external tubular element mounted on an end of said spray gun housing so as to intersect said duct, said valve being connected with said temperature detection means and said spark ignition device being mounted in a fixed manner on said external tubular element.

16. An apparatus according to claim 15, wherein said spark ignition device comprises a piezoelectric spark ignition device fixed to said mixing device, said piezoelectric spark ignition device being provided with an activation means for activating said piezoelectric spark ignition device such that said piezoelectric spark ignition device generates an electrical charge.

17. An apparatus according to claim 16, wherein said electrical charge is delivered to said mixing chamber via said conductor.

18. An apparatus according to claim 15, wherein said conductor element comprises at least one first portion extending longitudinally to the mixing device and said spark ignition device is arranged at a rear portion of the spray gun.

* * * * *